US005644794A

United States Patent [19]

Hull et al.

[11] Patent Number: 5,644,794

[45] Date of Patent: Jul. 8, 1997

[54] GARMENT FOR SECURING BINOCULARS/ CAMERA THERETO

[76] Inventors: Harold L. Hull, 401 Canyon Way #43, Sparks, Nev. 89434; Martin Harris, 3045 Attridge Pl., Reno, Nev. 89503

[21] Appl. No.: 631,157

[22] Filed: Apr. 12, 1996

[51] Int. Cl.[6] ..... A41D 1/04

[52] U.S. Cl. ..... 2/102; 2/69; 2/108; 224/909

[58] Field of Search ..... 2/102, 94, 108, 2/85, 69, 79, 51, 93, 48, 49.3; 224/901, 901.2, 908, 909, 215

[56] References Cited

U.S. PATENT DOCUMENTS

| | | | |
|---|---|---|---|
| 3,326,430 | 6/1967 | Banks . | |
| 3,661,308 | 5/1972 | Walters . | |
| 3,782,614 | 1/1974 | Campisi . | |
| 3,884,403 | 5/1975 | Brewer . | |
| 4,272,852 | 6/1981 | Bell . | |
| 4,320,863 | 3/1982 | Lyer et al. . | |
| 4,556,159 | 12/1985 | Swain . | |
| 4,637,075 | 1/1987 | Ingrisano | 2/94 |
| 4,637,535 | 1/1987 | Aleman . | |
| 5,440,761 | 8/1995 | Abrams et al. | 2/94 |

*Primary Examiner*—C. D. Crowder
*Assistant Examiner*—Gloria Hale

[57] ABSTRACT

Herein disclosed is substantially a garment which when worn by the wearer, allows the wearer to easily and quickly remove a pair of binoculars which are supported and releasably secured thereon. This garment further allows the wearer to simultaneously carry multiple articles of choice if so desired, such as a camera and/or even an animal-calling-device. Furthermore, we include a unique accessory item which is releasably adjustably attachable to the garment which allows the wearer to position the lens caps from a pair of binoculars therein, and when the wearer removes the binoculars from the garment, the lens caps are automatically retained in a secure safe manner within the accessory item.

18 Claims, 3 Drawing Sheets

GARMENT FOR SECURING BINOCULARS/ CAMERA THERETO

FIELD OF THE INVENTION

This invention relates to garments which include means to secure and support an article thereon, such as binoculars and/or a camera but more particularly to a garment having a removable support system attached thereto which is designed for comfort and allows the user to quickly and easily remove an article supported thereon for substantially spontaneous action and use.

BACKGROUND OF THE INVENTION

In the prior art, cameras, binoculars, sound equipment, breathing equipment and may other portable articles are commonly fitted with straps so that they may hang from the neck about the chest area in order that they may be raised to head or eye level for instant use. The problems of hanging relatively heavy articles about the neck for long periods of time by a single strap have been recognized for some time and there are now several harness arrangements available on the market and in related literature. Such harness arrangements are relatively expensive or suitable for only one type of equipment and therefore they have not found ready acceptance.

Furthermore, harness arrangements which support and distribute the weight of the article from a strap worn about the neck of the wearer are most undesirable, as this is very uncomfortable and can even cause damage to the nerves of the wearer.

The following references are exempliary of such harness arrangements designed to carry an article supported thereon from a strap worn about the neck of the wearer; U.S. Pat. Nos. 3,326,430, 3,661,308, 4,556,159 and 4,637,535.

It is to be noted that nowhere did the applicants find a garment (such as a coat), and/or (a removable support system which is attachable to the garment after market) which is specifically designed to carry and releasably secure a pair of binoculars thereto in the manner as taught by the present invention, although a closely related reference is U.S. Pat. No. 3,782,614 which teaches a "binocular pocket". The pocket is substantially a case which is shaped to receive a pair of binoculars therein with the case having a flap for removal of the binoculars therefrom. In a second embodiment the case is attached to a garment, namely a shirt, with the strap from the binoculars being contained within the collar of the shirt. This is a functional design but this case could not be used to support a camera and/or binoculars simultaneously, as can the present invention. Furthermore, they teach substantially a flap portion, which in theory allows the user to quickly remove the binoculars from the case, unfortunately, this in fact is not quickly accessible and becomes extremely bothersome, cumbersome and tends to be in the way of the user, unlike the present invention which substantially allows the wearer to access the binoculars very quickly and no use of flaps is taught.

SUMMARY OF THE INVENTION

It is therefore contended by the applicants that a need exists for a garment with a removable support system which is specifically designed to carry and releasably support an article thereon and further to distribute the weight of article evenly about the wearers shoulder area rather than distribute the weight about the wearers neck. Also, in use, it is very common to carry in combination a camera and a pair of binoculars, which the present invention addresses and allows.

Furthermore, the applicants contend that a need exists for an accessory item which is adjustably attached to the garment which will releasably and safely retain both lens caps of the binoculars when the binoculars are removed therefrom.

It is therefore an object of the present invention to provide a garment (such as a coat) which includes a removable support system to adjustably removably support and retain any article thereon, (such as a pair of binoculars and/or a camera).

It is another object of the present invention to provide a garment which includes a removable support system to adjustably removably support and retain multiple articles simultaneously thereon, (such as a pair of binoculars, a camera and an animal-calling-device) if so desired.

It is a further object of the present invention to provide a garment which includes a unique binocular support system comprising: a first and a second loop; a first and a second strap; a first and a second coupling means; an elongated fastener strap of the hook and loop variety, such as VELCRO and a first and a second panel of the hook and loop variety, such as VELCRO.

Yet another object of the present invention is to provide a garment having the above identified elongated fastener strap of the hook and loop variety, such as VELCRO includes means to releasably retain a camera therein.

Still another object of the present invention is to provide a garment having the above named elongated fastener strap of the hook and loop variety, such as VELCRO (which if so desired) may contain means to releasably secure an animal-calling-device therein.

Also an important object of the present invention is to provide a garment which includes a removable accessory item for removably retaining at least two binocular lens caps therein, and the lens caps are automatically released and retained within the accessory item when the binoculars are removed from the earlier identified binocular support means.

Still another important object is to provide a garment having a removable support system which supports an article therefrom and distributes the weight of the article about the wearers shoulder area, rather than supporting the weight from about the wearers neck, as taught by the prior art.

Yet another object of the present invention is to provide a binocular and/or camera support system which can be attached to a garment at the point of manufacture, or the support system may be sold separately and can be attached to any garment of choice by the consumer.

Other objects and advantages will be seen when taken into consideration with the following specification;

DETAILED DESCRIPTION OF THE DRAWINGS

Figure 1:
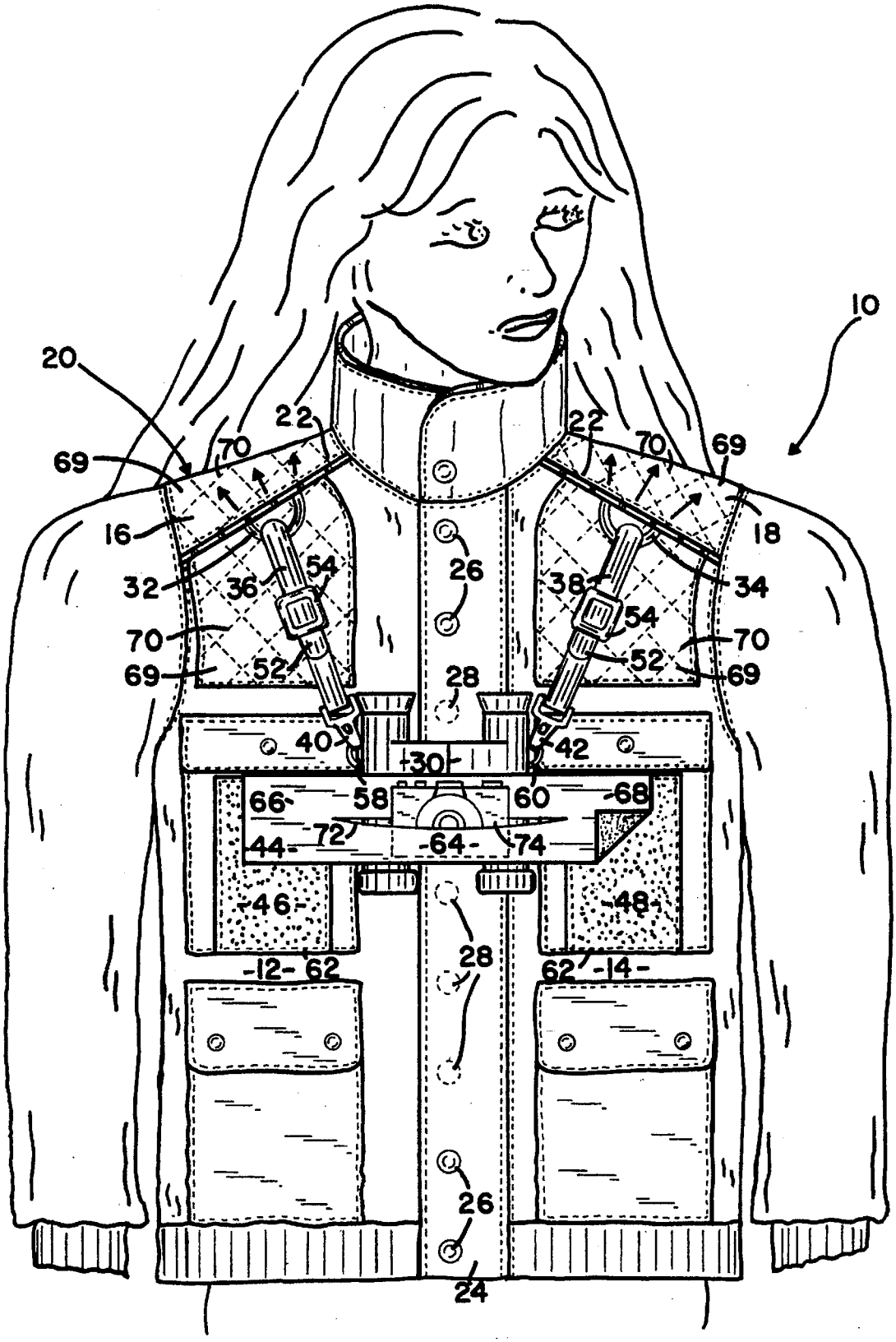
FIG. 1 is substantially a frontal overview of the present invention which is a garment having a removable support system thereon.

Referring now in detail to the drawings wherein like characters refer to like elements throughout the various views. Referring now to FIG. 1, wherein arrow (10) represents an overview of the present invention which is substantially a garment having a removable support system thereon which is used for supporting and removably securing an article of choice thereto. Garment (10) can be substantially any shape and size of choice, however, we have herein shown the garment to be substantially a typical coat or jacket which can be made from substantially any material of choice, such as cotton, Rayon, etc., or even waterproof material if preferred. The garment (10) substantially comprising a first and a second frontal section (12) & (14), a first and a second shoulder section (16) & (18) and a back section represented by arrow (20), with each of the frontal sections (12) & (14) and the back section (arrow 20) being of a sufficient length to extend from substantially the shoulder area of the wearer to substantially the waist area of the wearer, and each of the sections (12), (14) and (20) being interconnected by any suitable fastener means of choice, such as by stitching (22), so as to form the body of the garment (10) with the body being of a shape and size to substantially cover the upper body portion of the wearer.

Figure 2:
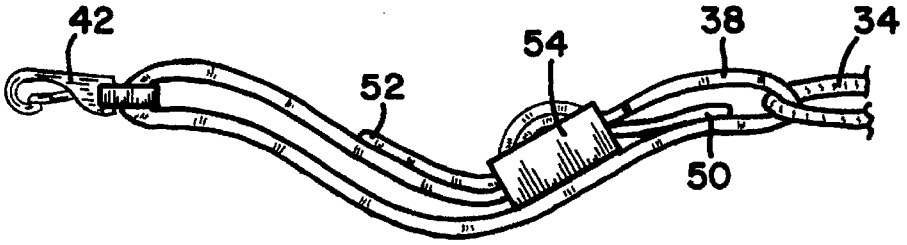
FIG. 2 is substantially a side view of the binocular support system.

Further shown in FIGS. 1 & 2, a portion of the second frontal section (14) overlaps a portion of the first frontal section (12) forming a flap (24) for retaining multiple releasable fastener means of choice therein, such as buttons or the like, or as we have shown, the multiple fastener means may be snaps (26), as clearly shown within FIG. 1. In the preferred embodiment, the multiple snaps are shown and include in combination exposed snaps (26) which are located at a position of choice upon the flap 24) and concealed snaps (28) which are positioned within the flap (24). With this unique snap arrangement, the concealed snaps (28) will not scratch the binoculars (30) when the binoculars are positioned upon the outside of the flap (24). It is to be noted that the garment may be made and sold with the following removable support system attached at the point of manufacture, or the support system may be sold separately and the consumer may attach the support system to substantially any garment of choice.

Further shown within FIGS. 1 & 2, we teach a unique binocular support system comprising of the following; a first and a second loop (32) & (34) which can be made from any suitable material of choice, such as cotton, Nylon, metal, etc., a first and a second strap (36) & (38) which can be made from any suitable material of choice, such as Nylon strapping, a first and a second coupling means of engineering choice, such as the typical J-hook variety (40) & (42) having a spring metal tongue which can be depressed by the user when removal and/or attaching an article thereto is desired, an elongated fastener strap (44) of the hook and loop variety, such as VELCRO and a first and a second panel (46) & (48) of the hook and loop variety such as VELCRO.

Further shown within FIGS. 1 & 2, the first loop (32) being fixedly attached to the first shoulder section (16) and the second loop (34) being fixidly attached to the second shoulder section (18) by any suitable fastener means of choice, such as by stitching (22) with the first strap (36) having its first end (50) inserted through the first loop (32) and its second end (52) inserted through the first coupling member, namely the J-hook (40) and the first end (50) and the second end (52) being adjustably attached together by a suitable adjustable fastener means of choice, such as the typical buckle type fastener (54) having a center bar, with the second strap (38) having its first end (50) inserted through the second loop (34) and its second end (52) inserted through the second coupling member, namely the J-hook (42) and the first end (50) and the second end (52) being adjustably attached together by a suitable adjustable fastener means of choice, such as the typical buckle type fastener (54) with the first coupling member, namely the J-hook (40) being removably attached to a first ring (58) located on the pair of binoculars (30) with the second coupling member, namely the J-hook (42) being removably attached to a second ring (60) located on the pair of binoculars (30). The first panel (46) of the hook and loop variety, such as VELCRO being affixed at a location of choice to the first frontal section (12) by any suitable means of choice, such as by adhesive, or stitching (62) and the second panel (48) of the hook and loop variety, such as VELCRO being affixed at a location of choice to the second frontal section (14) by any suitable means of choice, such as by adhesive, or stitching (62). The elongated fastener strap (44) of the hook and loop variety, such as VELCRO having its mid-portion (64) positionable over a portion of the binoculars (30) and the strap (44) having a first end (66) which is removably attached to the first panel (46) of the hook and loop variety, such as VELCRO and a second end (68) which is removably attached to the second panel (48) of the hook and loop variety, such as VELCRO. Therefore, when the binoculars (30) are positioned as shown and taught, the binoculars (30) are removably and adjustably secured to the body of the garment (10). It is to be noted that the binocular/camera support system is completely adjustable for individual use, as the straps (36) & (38) are adjustable up and down and the fastener strap (44) of the hook and loop variety, such as VELCRO may be positioned either higher or lower on the panels (46) & (48).

It is to be noted that one of the main objects of the present invention is to provide a garment having a removable support system which is extremely comfortable to wear and which further is designed to distribute the weight of an article attached thereto in an evenly distributed manner, this is exemplified by the arrows located on the shoulder area as depicted in FIG. 1. This comfortable distribution of weight is enhanced by the strap (44) which holds the binoculars/camera, etc., firmly in place laterally while walking, running, jumping, etc. and the distribution of weight is further aided by incorporating additional padding (69) for comfort of the wearer and also additional stitching (70) for reinforcement. It is to be noted that if so desired, the additional padding (69) may be of foam, nylon, or other material coated with neoprene rubber, or other known non-slip material, this provides a non-slip surface for a rifle sling (not shown).

Figure 6:
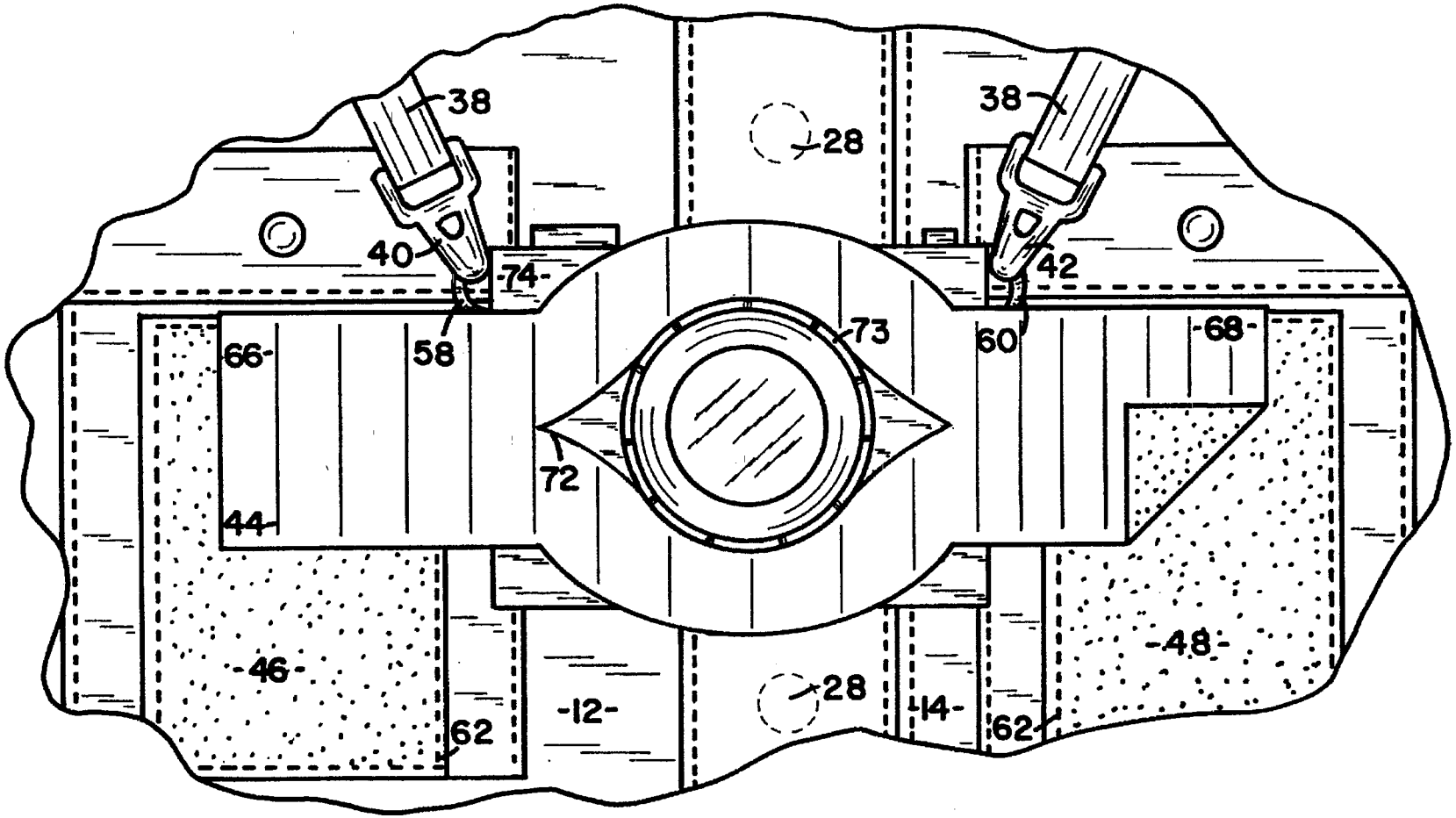
FIG. 6 is a partial front view showing means to retain a camera.

The elongated strap (44) includes means such as an elongated slot (72) which is of a shape and size to removably receive and support a camera (74) when positioned therein, or as we have shown in FIG. 6, the slot (72) may be used to removably retain the lens (73) of the camera (74) therein and the camera being supported and attached by the support system in the same manner as previously described. It is to be noted that if so desired, this slot may be used for the containment of a pocket (76), as illustrated within FIG. 2 and shown in ghost lines.

The elongated strap may also include (if desired) attachment means for removably retaining an animal-calling-device, such as a whistle used for calling birds, elk, deer etc., with the attachment means being at least two slots (80) which form substantially a loop (82) with the loop being of a size and shape to removably retain the animal-calling-device (78) therein.

Figure 3:
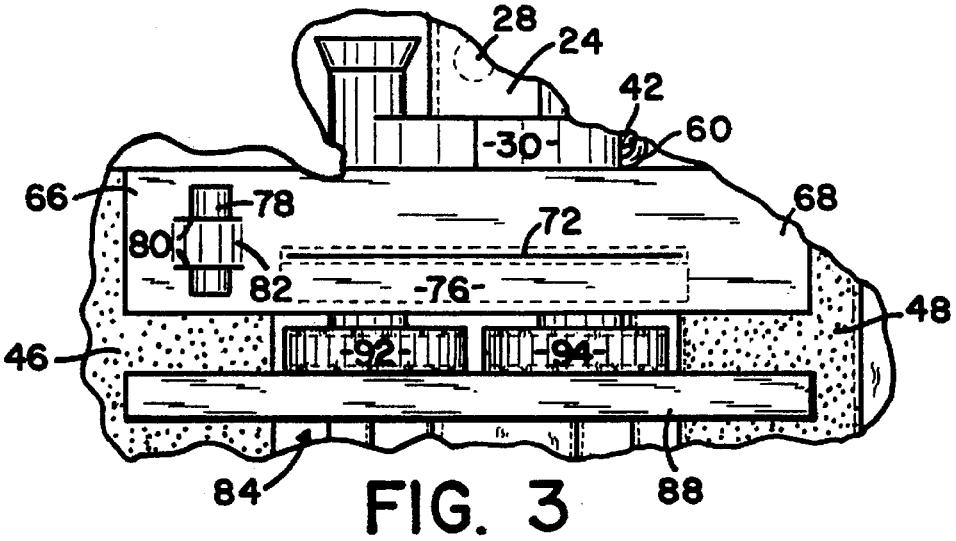
FIG. 3 is substantially a partial front view of an accessory item.
Figure 4:
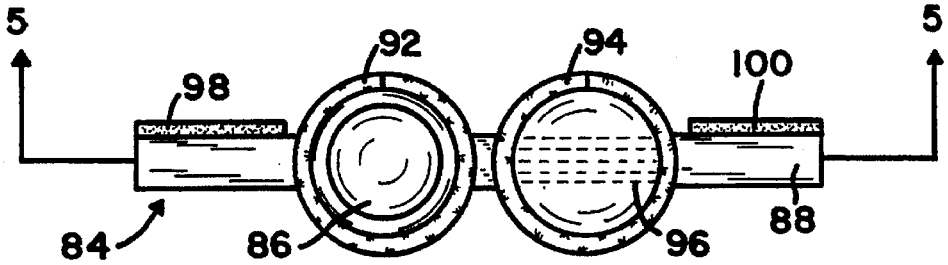
FIG. 4 is substantially a top view of the accessory item.
Figure 5:
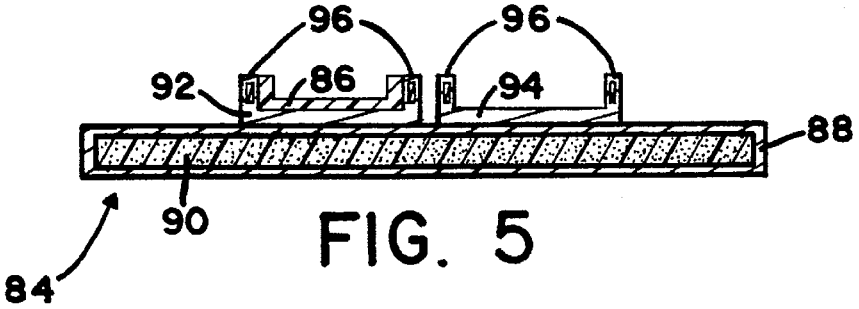
FIG. 5 is a sectional view taken at 5—5 of FIG. 4.

Referring now to FIGS. 3, 4 & 5, wherein the garment (10) having the support system thereon further includes an accessory item (represented by arrow 84) comprising of the following; an elongated substantially square member (88) which can be made from any material of choice, such as cotton, Rayon, etc., which is of a sufficient length size and shape to extend from the first panel (46) to the second panel (48) and the member (88) housing a stiffener or a support structure (90) which can be made from any material of choice such as an elongated substantially square section of foam-rubber. Furthermore, the member (88) includes a first and a second cup (92) & (94) which are fixidly attached thereto by suitable attachment means of choice, such as by adhesive or stitching (96), with the first and second cup (92) & (94) each being of a size and shape to removably adjustably receive one of the lens caps (86) therein and the first and second cup (92) & (94) each having elasticized sides (96) for adjustably receiving and retaining the lens caps (86) therein. Also, fastener means of the hook and loop variety, such as VELCRO strips (98) & (100) are provided to removably adjustably attach the member (88) to the first and second panels (46) & (48), whereby, when the binoculars (30) are withdrawn from engagement with the elongated strap (44), the first and the second cup (92) & (94) each retain one of the lens caps (86) therein. This feature allows the user to automatically remove the lens caps (86) from engagement with the binoculars without the possibility of loss thereof, and further quickens the reaction time of the user as they need not bother with the removal thereof and they will not worry about where the lens caps have gone, as is so often incurred within the prior art.

It will now be seen that we have herein provided a garment (such as a coat) having a removably attached support system which adjustably removably supports and retains an article thereon, (such as a pair of binoculars and/or a camera).

It will also be seen that we have herein provided a garment having a removably attached support system which adjustably removably supports and retains multiple articles simultaneously thereon, (such as a pair of binoculars, a camera and an animal-calling-device), if so desired.

It will further be seen that we have herein provided a garment which includes unique removably attached binocular and/or camera support system heretofore not seen nor taught.

Still further it will be seen that we have provided herein a garment which includes a removable accessory item which automatically retains and holds the lens caps of the binoculars in a safe and secure manner when the binoculars are removed from engagement with the binocular support system.

It will also be seen that we have herein provided a garment having a removably attached support system which distributes the weight of an article when supported thereon about the wearers shoulder area in a comfortable manner.

It will now be seen that we also teach a method of use for the garment including the following steps;

a. positioning the garment upon the wearer;

b. closing the flap portion of the garment;

c. attaching the binoculars to the J-hooks;

d. positioning the elongated strap over a portion of the binoculars;

e. attaching each end of the strap to its respective panel;

f. removing the lens caps from the binoculars;

g. inserting the lens caps into their respective cups with the cups being attached to their support structure;

h. positioning the binoculars within their respective caps; and attaching each end of the support structure to their respective panels.

Although the invention has been shown and described in what is conceived to be the most practical and preferred embodiment it is recognized that departures may be made therefrom within the scope and spirit of the invention, which is not to be limited to the details disclosed herein but is to be accorded the full scope of the claims so as to embrace any and all equivalent devices and/or apparatuses.

What we claim as new and desire to secure by LETTERS PATENT is:

1. A garment for supporting and removably securing a pair of binoculars thereto, said garment comprising: a first and a second frontal section; a first and a second shoulder section; and a back section, each of said frontal sections and said back section being of a length to extend from substantially the shoulder area of the wearer to substantially the waist area of the wearer and each of said sections being interconnected so as to form the body of said garment with the body being of a shape and size to substantially cover the upper body portion of the wearer, and a portion of said second frontal section overlapping a portion of said first frontal section forming a flap for retaining releasable fastener means therein, a binocular support system comprising: a first and a second loop; a first and a second strap; each having a first and second end a first and a second coupling means; an elongated hook and loop strap; having substantially a mid-portion and a first and a second hook and loop panel, said first loop being fixedly attached to said first shoulder section and said second loop being fixidly attached to said second shoulder section, said first end of said first strap being inserted through said first loop and said second end of said first strap being inserted through said first coupling member and said first and said second end of said first strap being adjustably attached together by suitable adjustable fastener means, said first end of said second strap being inserted through said second loop and said second end of said strap being inserted through said second coupling member and said first and said second end of said second strap being adjustably attached together by suitable adjustable fastener means, said first coupling member being removably attached to a first ring located on a pair of binoculars, said second coupling member being removably attached to a second ring on said binoculars, said first hook and loop panel being affixed at a location of choice to said first frontal section, said second hook and loop panel being affixed at a location of choice to said second frontal section, said elongated hook and loop strap having said mid-portion positionable over a portion of said binoculars and having a first end removably attached to said first hook and loop panel and a second end removably attached to said second hook and loop panel, whereby;

said binoculars are removably and adjustably secured to said body of said garment.

2. The garment of claim 1 in which said flap for retaining releasable fastener means therein, said fastener means being multiple snaps.

3. The garment of claim 2 in which said multiple snaps include in combination exposed snaps located at a position of choice upon said flap and concealed snaps positioned substantially within said flap, whereby;

said concealed snaps will not scratch said binoculars when said binoculars are positioned upon said flap.

4. The garment of claim 1 in which said first and second coupling means are of the J-hook variety having a spring metal tongue.

5. The garment of claim 1 in which said suitable adjustable fastener means is of the buckle type having a center bar.

6. The garment of claim 1 in which said first and said second frontal section and said first and said second shoulder section each have additional padding for comfort of the wearer and additional stitching for reinforcement.

7. The garment of claim 1 in which said elongated hook and loop strap includes means to removably receive and support a camera.

8. The garment of claim 7 wherein said means to support a camera is by said elongated hook and loop strap having an elongated slot which is of a shape and size to removably receive said camera when positioned therein.

9. The garment of claim 7 wherein said means to support a camera is by said elongated hook and loop strap having a pocket which is of a shape and size to removably receive said camera when positioned therein.

10. The garment of claim 1 in which said elongated hook and loop strap includes a slot to removably receive and support the lens of a camera therethrough.

11. The garment of claim 1 in which said elongated hook and loop strap includes means to removably receive and support an animal-calling-device.

12. The garment of claim 11 in which said means to removably receive and support an animal-calling-device is by said elongated strap having at least two slots which form a loop and said loop being of a size and shape to removably retain said animal-calling-device therein.

13. The garment of claim 1 including an accessory item for removably retaining at least two binocular lens caps therein, said accessory item comprising: an elongated substantially square member; a first and a second cup each attached to said member; and means to removably adjustably attach said member to said first and said second hook and loop panel, said member housing a support structure, said member being of a sufficient length size and shape to extend from said first hook and loop panel to said second hook and loop panel, said first and said second cup each being of a size and shape to removably receive one of said lens caps therein and said first and said second cup each having elasticized sides for adjustably retaining said lens caps therein, whereby;

when said binoculars are withdrawn from engagement with said elongated hook and loop strap, said first and said second cup each retain one of said lens caps therein.

14. The garment of claim 13 in which said means to removably adjustably attach said member to said first and said second hook and loop panels is by hook and loop strips.

15. The garment of claim 13 in which said member housing a support structure, said structure is an elongated substantially square section of foam-rubber.

16. An article support system comprising: a first and a second loop; a first and a second strap; each having a first and second end; a first and a second coupling means; an elongated hook and loop strap; having substantially a mid-portion and a first and a second hook and loop panel, said first loop being fixedly attachable to substantially any garment of choice having a first shoulder section and said second loop being fixedly attachable to said garment which has a second shoulder section, said first end of said first strap being inserted through said first loop and said second end of said first strap being inserted through said first coupling member and said first and said second end of said first strap being adjustably attached together by suitable adjustable fastener means, said first end of said second strap being inserted through said second loop and said second end of said second strap being inserted through said second coupling member and said first and said second end of said second strap being adjustably attached together by suitable adjustable fastener means, said first coupling member being removably attached to a first ring located on said article, said second coupling member being removably attached to a second ring on said article, said first hook and loop panel being affixed at a location of choice to said first frontal section, said second hook and loop panel being affixed at a location of choice to said second frontal section, said elongated hook and loop strap having said mid-portion positionable over a portion of said article and having a first end removably attached to said first hook and loop panel and a second end removably attached to said second hook and loop panel, whereby;

said article is removably and adjustably secured to the body of said garment.

17. The support system of claim 16 wherein said article is a pair of binoculars.

18. The support system of claim 16 wherein said article is a camera.

* * * * *